US007536835B2

(12) United States Patent
Schlüter

(10) Patent No.: US 7,536,835 B2
(45) Date of Patent: May 26, 2009

(54) FLOOR CONSTRUCTION COVERED WITH CERAMIC TILES

(75) Inventor: Werner Schlüter, Iserlohn (DE)

(73) Assignee: Schlüter-Systems KG, Iserlohn (DE)

( * ) Notice: Subject to any disclaimer, the term of this patent is extended or adjusted under 35 U.S.C. 154(b) by 44 days.

(21) Appl. No.: 11/402,772

(22) Filed: Apr. 12, 2006

(65) Prior Publication Data

US 2006/0260233 A1 Nov. 23, 2006

(30) Foreign Application Priority Data

Apr. 13, 2005 (DE) ..... 10 2005 016 963
Jan. 31, 2006 (EP) ..... 06101098

(51) Int. Cl.
*E04F 15/02* (2006.01)

(52) U.S. Cl. ..... 52/390; 52/385; 52/389; 52/302.1; 52/411

(58) Field of Classification Search ..... 52/408, 52/409, 411, 390, 385, 386, 387, 388, 389, 52/392, 384, 302.1, 169.5
See application file for complete search history.

(56) References Cited

U.S. PATENT DOCUMENTS 1,277,622 A 9/1918 Madison
1,302,822 A 5/1919 Madison
1,965,282 A 7/1934 Ellithorpe et al.
2,030,556 A 2/1936 Veltung
3,025,772 A 3/1962 Palatini
3,086,899 A 4/1963 Smith et al.
3,238,682 A 3/1966 Tracy et al.
3,419,457 A 12/1968 Bleasdale
4,637,184 A * 1/1987 Radtke et al. ..... 52/220.4
4,917,933 A 4/1990 Schlüter
4,932,182 A 6/1990 Thomasson
5,052,161 A * 10/1991 Whitacre ..... 52/385
5,255,482 A * 10/1993 Whitacre ..... 52/390

(Continued)

FOREIGN PATENT DOCUMENTS

DE 26 50 160 5/1978

(Continued)

OTHER PUBLICATIONS

Die Branche aus einer Hand Fliesen Platten, Schadensfrei verlegen, "Wissen macht erfinderisch," Nov. 2000, pp. 87-88 and two (2) unnumbered pages. (With English Translation).

*Primary Examiner*—Robert J Canfield
*Assistant Examiner*—Jessie Fonseca
(74) *Attorney, Agent, or Firm*—Collard & Roe, P.C.

(57) ABSTRACT

A floor construction covered with ceramic tiles, in which a film-like plastic mat having support elements disposed in a uniform area distribution, hollow towards the underside, capable of support, projecting out beyond the top of the mat, is applied on the sub-floor. Channels carrying open water are formed between the support elements, and a water-permeable or vapor-permeable covering in the manner of a non-woven fabric or woven fabric is disposed on the support elements. The plastic mat is embedded and attached, supported in a still soft, hardening thin-bed mortar layer on the sub-floor, over its full area, in the region of its lower contact surfaces. The ceramic tiles are laid and attached on the covering in the manner of a non-woven fabric, directly, with a thin-bed mortar layer.

26 Claims, 3 Drawing Sheets

U.S. PATENT DOCUMENTS 5,383,314 A * 1/1995 Rothberg ..... 52/169.5
5,489,462 A 2/1996 Sieber
5,566,522 A 10/1996 Ålander et al.
5,572,842 A 11/1996 Stief et al.
5,619,832 A 4/1997 Myrvold
5,775,039 A 7/1998 McPherson
5,822,937 A 10/1998 Mahony et al.
5,860,259 A * 1/1999 Laska ..... 52/302.3
5,956,921 A * 9/1999 Fleck et al. ..... 52/741.3
5,979,133 A * 11/1999 Funkhouser ..... 52/408
6,151,854 A * 11/2000 Gutjahr ..... 52/385
6,167,668 B1 * 1/2001 Fine et al. ..... 52/403.1
6,286,279 B1 * 9/2001 Bean et al. ..... 52/390
6,434,901 B1 8/2002 Schlüter
6,691,472 B2 * 2/2004 Hubert ..... 52/169.5
6,786,013 B2 * 9/2004 Coulton ..... 52/198
6,802,668 B2 * 10/2004 Parker ..... 405/49

FOREIGN PATENT DOCUMENTS

| | | |
|---|---|---|
| DE | 33 13 476 | 10/1984 |
| DE | 37 01 414 | 7/1988 |
| DE | G 90 11 271.1 | 11/1990 |
| DE | 298 06 561 | 1/1998 |
| DE | 298 07 258 | 9/1998 |
| DE | 299 15 866 | 5/2000 |
| DE | 200 20 316 | 3/2002 |
| DE | 203 17 247 | 3/2004 |
| EP | 1 068 413 | 10/2003 |
| FR | 1 444 070 | 5/1965 |
| FR | 2 544 460 | 10/1984 |
| GB | 2 141 459 | 12/1984 |
| GB | 2141459 A * | 12/1984 |
| WO | WO 82/03099 | 9/1982 |
| WO | WO 99/55985 | 11/1999 |

* cited by examiner

FLOOR CONSTRUCTION COVERED WITH CERAMIC TILES

BACKGROUND OF THE INVENTION

1. Field of the Invention

The invention relates to a floor construction covered with ceramic tiles, in which a film-like plastic mat having support elements disposed in a uniform area distribution, hollow towards the underside, capable of support, projecting out beyond the top of the mat, is applied on the sub-floor. Channels carrying open water are formed between the support elements, and a water-permeable or vapor-permeable covering in the manner of a non-woven fabric or woven fabric is disposed on the support elements, above which ceramic tiles laid using the adhesive method are disposed.

2. The Prior Art

Such a floor construction is known from German Patent No. DE 90 11 271 U1. In this connection, a film-like plastic mat in the manner of a nub panel is loosely laid onto the sub-floor, for example a concrete plate or a hardened gradient floor pavement. Applying such a tile to a liquid floor pavement is not possible. Such an application, or even pressing it down, would never result in a permanent attachment of the tile. For the required load distribution, a relatively thick layer of mortar is applied to the top of this plastic mat, which top is covered with a non-woven fabric or the like, on which mortar layer the ceramic tiles are attached by means of appropriate adhesives, for example thin-bed mortar or tile adhesive. In the case of such a floor construction, the load distribution layer configured as a mortar layer is absolutely necessary, in order to be able to apply the vertical stresses that act on the tile covering of the floor distributed on the sub-floor by way of the film-like plastic mat, since the corresponding effective support surfaces on the underside of the plastic mat are relatively slight, in view of the hardened sub-floor, which is not completely level in practice. Such a floor construction therefore requires a load distribution layer having a significant construction height.

SUMMARY OF THE INVENTION

It is therefore an object of the invention to reduce the height of such a floor construction, while nevertheless guaranteeing sufficient load distribution.

This object is accomplished with a floor construction in which a film-like plastic mat having support elements disposed in a uniform area distribution, hollow towards the underside, capable of support, projecting out beyond the top of the mat, is applied on the sub-floor. Channels carrying open water are formed between the support elements, and a water-permeable or vapor-permeable covering in the manner of a non-woven fabric or woven fabric is disposed on the support elements, above which ceramic tiles laid using the adhesive method are disposed. The plastic mat is embedded and attached, supported in a still soft, hardening thin-bed mortar layer on the sub-floor, over its full area, in the region of its lower contact surfaces. The ceramic tiles are laid and attached on the covering in the manner of a non-woven fabric, directly, with a thin-bed mortar layer. As a result of the full-area embedding of the available contact surfaces of the underside of the film-like plastic mat capable of support, in a soft, still hardening thin-bed mortar layer, the available lower contact surfaces of the plastic mat are completely used for load transfer. The plastic mat is therefore supported on the sub-floor in a better manner, as compared with a floor construction according to the state of the art, after the thin-bed mortar layer has hardened. Therefore, the ceramic tile covering can be applied to the top of the plastic mat covered with a non-woven fabric or the like, directly onto a plastic mat that has been supported in this manner, using a thin-bed mortar layer. The height of such a floor construction is significantly reduced as compared with constructions according to the state of the art. Furthermore, the application of the mortar layer that serves as the load distribution layer is eliminated, thereby resulting in significant cost savings.

Preferably, nub sheets are used, the contact surfaces of which carry the covering in the manner of a non-woven fabric.

In one embodiment, lower nubs are disposed between all of the nubs that carry the covering in the manner of a non-woven fabric, or individual ones of these nubs, which lower nubs have undercuts on their lower, open side, for clamping the thin-bed mortar that has penetrated. In this way, the attachment of the nub panel on the sub-floor is improved and, at the same time, the support area is increased, since the lower nubs are selected, in terms of their height, in such a manner that they fill out completely when pressed into the thin-bed mortar that is still wet.

A simplified floor construction is provided in another embodiment, where the support elements are configured in strip-like manner, with a preferably U-shaped cross-section. The water-removing channels are formed between the strips on the top of the plastic mat. In case of lower stress requirements, it is also possible to do without a load-distribution layer in the case of such a floor construction.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
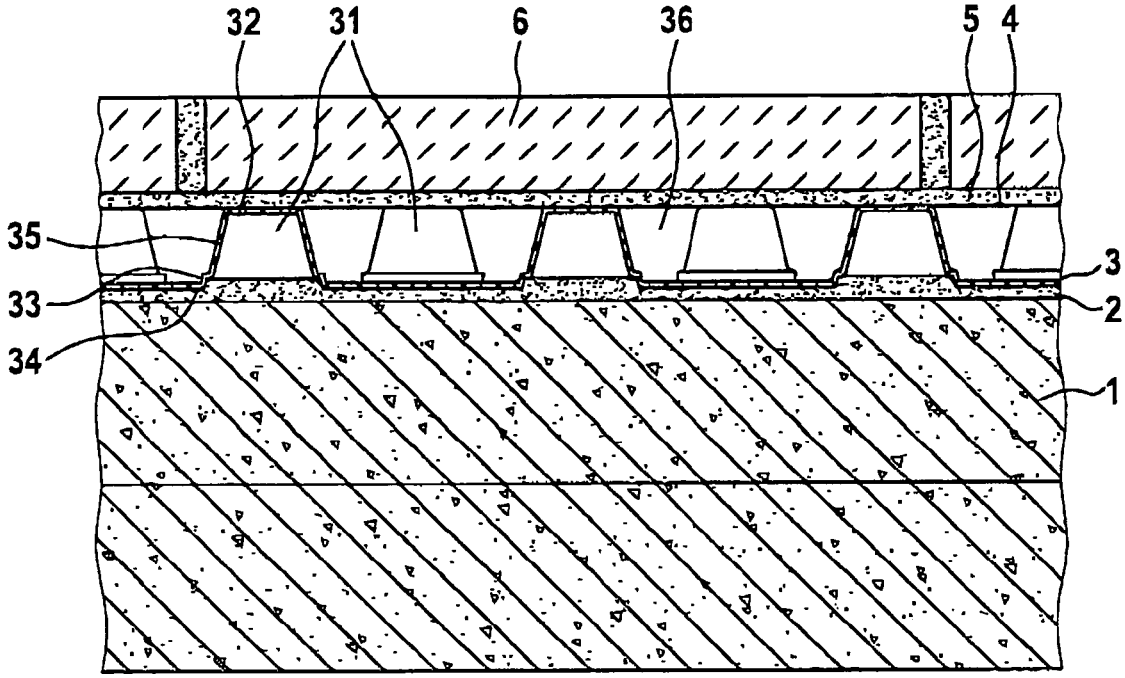
FIG. 1 shows a schematic cross-sectional representation through a floor construction.

First, reference will be made to FIGS. 1 and 2. On a suitable sub-floor 1, for example a concrete plate having a hardened gradient floor pavement, a hardening thin-bed mortar layer 2 is applied in the manner of a tile adhesive or another corresponding priming mass. In this thin-bed mortar 2, which has not yet hardened, a film-like plastic mat 3 is embedded with its underside, in such a manner that its contact surfaces 33, 34 that are available on the underside are completely supported, with a correspondingly level, i.e. horizontal arrangement.

Figure 2:
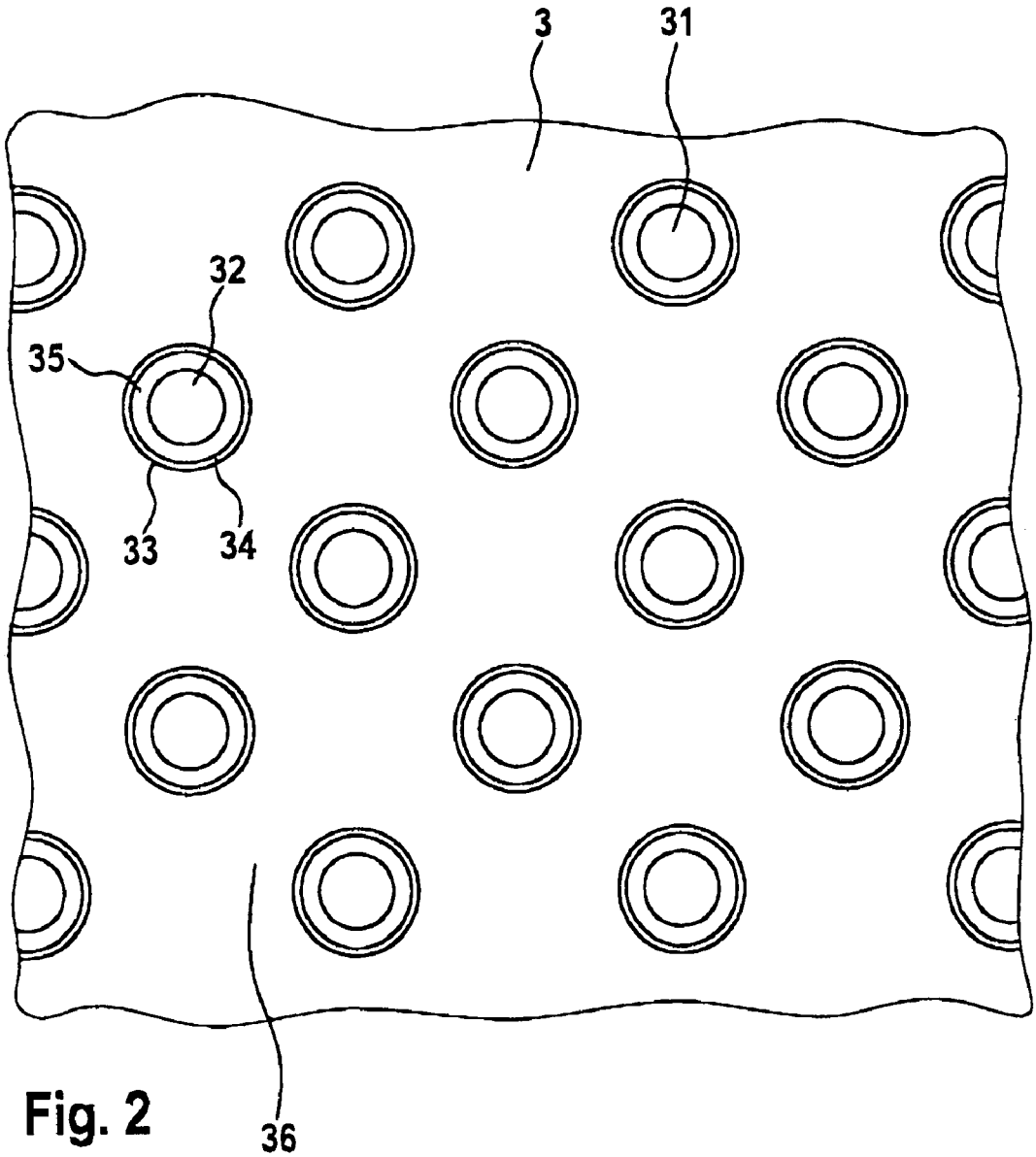
FIG. 2 shows a view from below of the plastic mat used in the floor construction according to FIG. 1, in the configuration of a nub panel with nubs of equal height.

Plastic mat 3 shown in FIGS. 1 and 2 is a nub panel, in which hollow nubs 31 that project upward, in the shape of a truncated cone, are formed with a uniform area distribution, with tops 32. Between these nubs, open channels 36 are formed for water removal towards the outside. The embedded contact surfaces 34 that serve for support are enlarged by means of steps 33 in the transition region from contact surfaces 34 to nub walls 35, in each instance, which steps form a ring surface.

On tops 32 of nubs 31 in the shape of a truncated cone, a water-permeable and vapor-permeable covering 4 in the manner of a non-woven fabric is glued on. In this covering 4, in turn, a thin-bed mortar layer 5 is applied, with which ceramic tiles 6 disposed above it are attached. Instead of nubs in the shape of truncated cones, nubs in the shape of a truncated pyramid can also be configured on such a plastic mat capable of support.

There is also the possibility of configuring corresponding structure elements of a plastic mat in strip-like manner, with a preferably U-shaped cross-section, whereby water-removing channels are formed between the strips, on the top of such a mat.

In addition, clamping elements can also be provided on the underside of the plastic mats, in the manner of a grid-like woven fabric 40 or the like. With such measures, the plastic mat is bonded more strongly in the hardening thin-bed mortar layer. To improve adhesion, it is also possible to provide a roughening coating or a roughened surface structure of the lower contact surfaces of the plastic mat.

Figure 3:
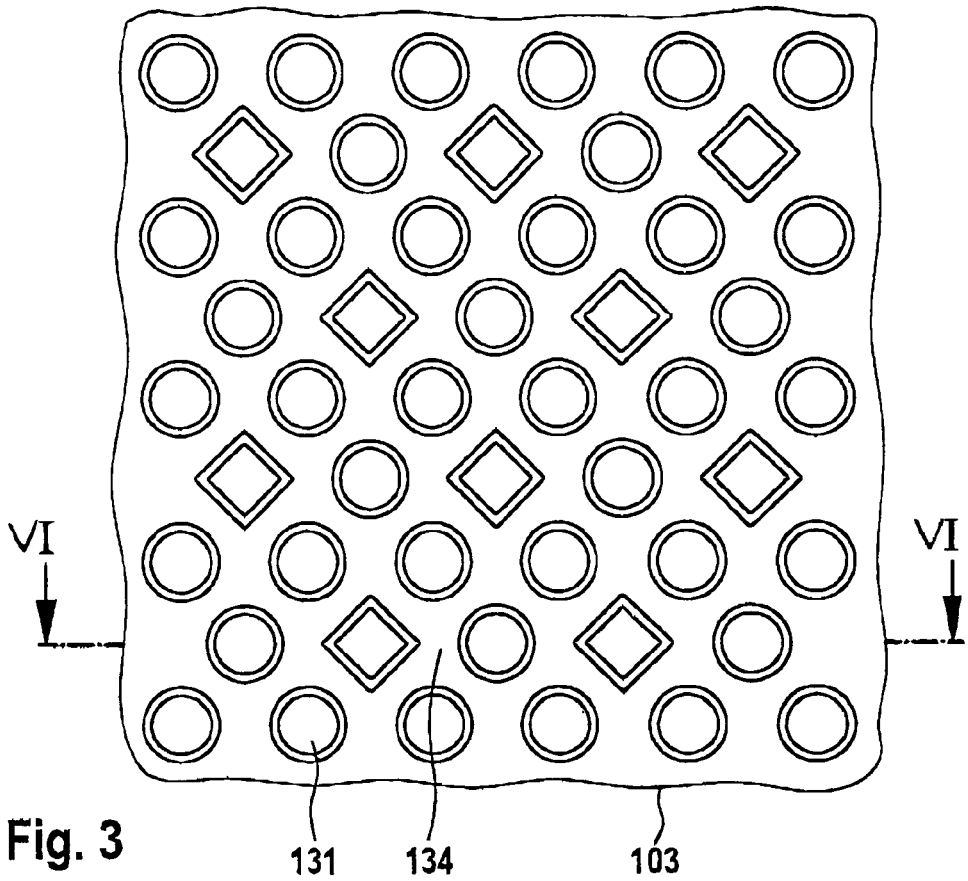
FIG. 3 shows a top view of a partial representation of another nub panel.
Figure 4:
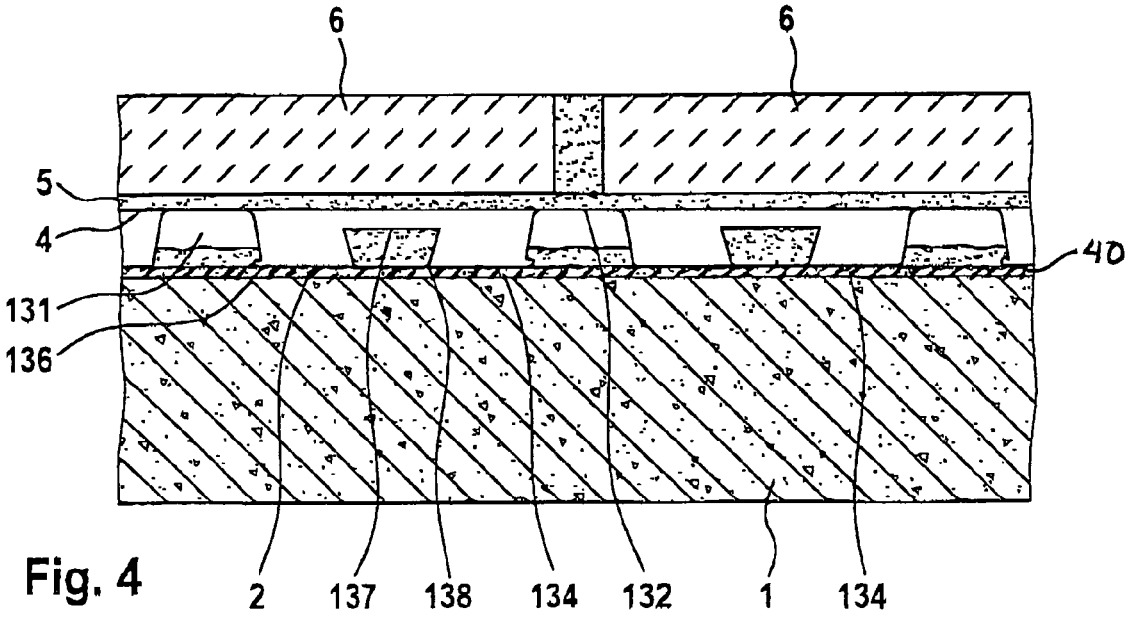
FIG. 4 shows a section along the line VI-VI in FIG. 3.

FIGS. 3 and 4 show a plastic mat 103 in a floor construction covered with ceramic tiles, in which lower nubs 137 are disposed between all or individual ones of nubs 131 that carry covering 4 in the manner of a non-woven fabric, which former nubs have undercuts 138, open on their underside, for clamping penetrated thin-bed mortar 2. On tops 132 of higher nubs 131, a covering 4 in the manner of a non-woven fabric is again attached, on which ceramic tiles 6 are attached with a thin-bed mortar 5. These ceramic tiles with the thin-bed mortar bonded onto them, and the covering 4 in the manner of a non-woven fabric, bridge the interstices between two higher nubs 131, between which a lower nub 137 is disposed, in this connection, with sufficient support.

Preferably, the height of lower nubs 137 approximately corresponds to half the height of higher nubs 131. In the case of these plastic mats, a great number of nubs 131 and 137 is formed, so that the load distribution nevertheless takes place in a uniform distribution, by way of many individual ones of the higher nubs 131. Lower nubs 137 fill completely with mortar 2 when they are pressed into the thin-bed mortar layer that is still hardening, which is combed up in usual manner. In this connection, undercuts 138 on the open underside of these nubs 137 achieve strong clamping of mat 103 to sub-floor 1. In addition, higher nubs 131 can also have circumferential undercuts 136, or undercuts in certain regions, on their open underside. In FIG. 4 these higher nubs do not fill completely with thin-bed mortar 2.

Nubs 131 and 137 are disposed at relatively small intervals from one another. In an exemplary embodiment, the distances between center points are approximately 10-30 mm. The maximal height of a panel 103 and therefore the height of the higher nubs 131 lies between 3-12 mm.

Accordingly, while only a few embodiments of the present invention have been shown and described, it is obvious that many changes and modifications may be made thereunto without departing from the spirit and scope of the invention.

REFERENCE SYMBOL LIST

| | |
|---|---|
| 1 | sub-floor |
| 2 | thin-bed mortar layer |
| 3 | plastic mat |

-continued

| | |
|---|---|
| 31 | nub |
| 32 | top |
| 33 | step |
| 34 | contact surface |
| 35 | nub wall |
| 36 | channel |
| 40 | grid-like woven fabric |
| 4 | covering in the manner of a non-woven fabric |
| 5 | thin-bed mortar |
| 6 | ceramic tile |
| 103 | plastic mat |
| 131 | nub |
| 132 | top |
| 134 | contact surface |
| 136 | undercut |
| 137 | nub |
| 138 | undercut |

What is claimed is:

1. A floor construction, comprising:

a film-like plastic mat comprising a nub panel having support elements comprising nubs disposed in a uniform area distribution, hollow towards an underside, said nubs being adapted for supporting and projecting out beyond a top of the mat, said mat having lower contact surfaces disposed between the nubs, wherein said mat is embedded and attached, supported in a still soft, hardening thin-bed mortar layer on a sub-floor, over a full area of the mat, by the lower contact surfaces and said nubs having upper contact surfaces;

channels formed between the nubs and being adapted for carrying open water;

a water-permeable or vapor-permeable covering of a non-woven fabric or woven fabric disposed on top of the nubs and attached to the upper contact surfaces;

lower nubs disposed between all or individual ones of the nubs that carry the covering, said lower nubs having undercuts on a lower side, for clamping thin-bed mortar that has penetrated; and ceramic tiles laid on and directly attached to the covering with a thin-bed mortar layer.

2. The floor construction according to claim 1, wherein the nubs that carry the covering have undercuts, in a region of their open underside, for clamping the penetrated thin-bed mortar.

3. The floor construction according to claim 1, wherein the individual nubs are configured as a truncated pyramid.

4. A floor construction according to claim 1, wherein the nubs, in a transition region from an underside contact surface to a nub wall, have a step forming a ring surface.

5. The floor construction according to claim 1, wherein the plastic mat is configured to be adhesion-improving on its contact surface.

6. The floor construction according to claim 5, wherein a grid-like woven fabric is applied on the underside of the plastic mat.

7. The floor construction according to claim 5, wherein the underside of the plastic mat that forms the contact surfaces has a roughened structure.

8. The floor construction according to claim 5, wherein the portions of the underside of the plastic mat that form the contact surfaces are provided with a rough coating.

9. The floor construction according to claim 1, wherein a height of the lower nubs corresponds to approximately half of a height of the other nubs.

10. A floor construction, comprising:

a film-like plastic mat having support elements comprising nubs disposed in a uniform area distribution, hollow towards an underside, said nubs being adapted for supporting and projecting out beyond a top of the mat, said mat having lower contact surfaces disposed between the nubs, wherein said mat is embedded and attached, supported in a still soft, hardening thin-bed mortar layer on a sub-floor, over a full area of the mat, by the lower contact surfaces;

channels formed between the nubs and adapted for carrying open water;

a water-permeable or vapor-permeable covering of a non-woven fabric or woven fabric disposed on upper contact surfaces of the nubs; and ceramic tiles laid on and directly attached to the covering with a thin-bed mortar layer, wherein the nubs, in a transition region from an underside contact surface to a nub wall, have a step forming a ring surface.

11. The floor construction according to claim 10, wherein lower nubs are disposed between all or individual ones of the nubs that carry the covering, said lower nubs having undercuts on a lower side, for clamping thin-bed mortar that has penetrated.

12. The floor construction according to claim 11, wherein the nubs that carry the covering have undercuts, in a region of their open underside, for clamping the penetrated thin-bed mortar.

13. The floor construction according to claim 11, wherein a height of the lower nubs corresponds to approximately half of a height of the other nubs.

14. The floor construction according to claim 10, wherein the individual nubs are configured as a truncated pyramid.

15. The floor construction according to claim 10, wherein the plastic mat is configured to be adhesion-improving on its lower contact surface.

16. The floor construction according to claim 15, wherein a grid-like woven fabric is applied on the underside of the plastic mat.

17. The floor construction according to claim 15, wherein the underside of the plastic mat that forms the contact surfaces has a roughened structure.

18. The floor construction according to claim 15, wherein the portions of the underside of the plastic mat that form the contact surfaces are provided with a rough coating.

19. A floor construction, comprising:

a film-like plastic mat having support elements disposed in a uniform area distribution, hollow towards an underside, said support elements being adapted for supporting and projecting out beyond a top of the mat, said mat having lower contact surfaces disposed between the support elements, wherein said mat is embedded and attached, supported in a still soft, hardening thin-bed mortar layer on a sub-floor, over a full area of the mat, by the lower contact surfaces;

channels formed between the support elements and adapted for carrying open water;

a water-permeable or vapor-permeable covering of a non-woven fabric or woven fabric disposed on top of the support elements;

a grid-like woven fabric applied to the lower contact surfaces; and ceramic tiles laid on and directly attached to the covering with a thin-bed mortar layer, wherein the plastic mat is a nub panel and wherein said support elements are nubs that are open towards the underside, the nubs having upper contact surfaces that carry the covering, and wherein lower nubs are disposed between all or individual ones of the nubs that carry the covering, said lower nubs having undercuts on a lower side, for clamping thin-bed mortar that has penetrated.

20. The floor construction according to claim 19, wherein the nubs that carry the covering have undercuts, in a region of their open underside, for clamping the penetrated thin-bed mortar.

21. The floor construction according to claim 19, wherein the individual nubs are configured as a truncated pyramid.

22. The floor construction according to claim 19, wherein a height of the lower nubs corresponds to approximately half of a height of the other nubs.

23. A floor construction, comprising:

a film-like plastic mat having support elements disposed in a uniform area distribution, hollow towards an underside, said support elements being adapted for supporting and projecting out beyond a top of the mat, said mat having lower contact surfaces disposed between the support elements, wherein said mat is embedded and attached, supported in a still soft, hardening thin-bed mortar layer on a sub-floor, over a full area of the mat, by the lower contact surfaces;

channels formed between the support elements and adapted for carrying open water;

a water-permeable or vapor-permeable covering of a non-woven fabric or woven fabric disposed on top of the support elements;

a grid-like woven fabric applied to the lower contact surfaces; and ceramic tiles laid on and directly attached to the covering with a thin-bed mortar layer, wherein the plastic mat is a nub panel and wherein said support elements are nubs that are open towards the underside, the nubs having upper contact surfaces that carry the covering, and wherein the nubs, in a transition region from a lower contact surface to a nub wall, have a step forming a ring surface.

24. The floor construction according to claim 19, wherein the plastic mat is configured to be adhesion improving on its lower contact surface.

25. The floor construction according to claim 24, wherein the underside of the plastic mat that forms the contact surface has a roughened structure.

26. The floor construction according to claim 24, wherein the portions of the underside of the plastic mat the form the contact surface are provided with a rough coating.

* * * * *